US008099835B2

(12) United States Patent
Artzt et al.

(10) Patent No.: US 8,099,835 B2
(45) Date of Patent: Jan. 24, 2012

(54) WEARING COATING FOR DELIVERY ROLLERS OF A DRAWING ROLLER FRAME

(75) Inventors: Peter Artzt, Reutlingen (DE); Heinz Muller, Metzingen-Neuhausen (DE)

(73) Assignee: Deutsche Institute fur Textile-und Faserforschung Stuttgart, Denkendorf (DE)

( * ) Notice: Subject to any disclaimer, the term of this patent is extended or adjusted under 35 U.S.C. 154(b) by 335 days.

(21) Appl. No.: 12/282,031

(22) PCT Filed: Jan. 24, 2007

(86) PCT No.: PCT/EP2007/050675

§ 371 (c)(1),
(2), (4) Date: Feb. 3, 2009

(87) PCT Pub. No.: WO2007/101742

PCT Pub. Date: Sep. 13, 2007

(65) Prior Publication Data

US 2009/0144942 A1 Jun. 11, 2009

(30) Foreign Application Priority Data

Mar. 8, 2006 (DE) ..... 10 2006 011 128

(51) Int. Cl.
*D01H 5/86* (2006.01)

(52) U.S. Cl. ..... 19/244; 19/249

(58) Field of Classification Search ..... 19/244, 19/249; 57/315

See application file for complete search history.

(56) References Cited

U.S. PATENT DOCUMENTS

| | | | | |
|---|---|---|---|---|
| 7,140,172 | B2 | 11/2006 | Artzt et al. | |
| 2001/0018823 | A1* | 9/2001 | Dinkelmann et al. | 57/315 |
| 2006/0075738 | A1* | 4/2006 | Artzt et al. | 57/315 |
| 2007/0169459 | A1 | 7/2007 | Artzt et al. | |

FOREIGN PATENT DOCUMENTS

| | | |
|---|---|---|
| DE | 816 069 | 8/1951 |
| DE | 41 04 249 A1 | 8/1992 |
| EP | 1 548 162 A2 | 6/2005 |
| FR | 2 445 400 | 7/1980 |
| GB | 1115179 | 5/1968 |

OTHER PUBLICATIONS

PCT Search Report, May 23, 2007.
German Patent Office Search Report, Sep. 11, 2006.
PCT International Preliminary Report on Patentability, Nov. 3, 2008.

* cited by examiner

*Primary Examiner* — Shaun R Hurley
(74) *Attorney, Agent, or Firm* — Dority & Manning, P.A.

(57) ABSTRACT

The coating of the pressure roller (3) of a drawing roller frame for spinning frames comprises an outer layer and an inner layer fixed to the core of the pressure roller. The outer layer is thinner and harder than the inner layer and is embodied as an endless belt (1) which loosely surrounds the inner layer such that the belt can be displaced in relation to the inner layer. In order to improve the running of the belt, the belt is guided over a deflector rail (2), the cross-sectional area (u) of the rail being wider than the average staple length of the fibre material (F) drawn on the drawing roller frame. Furthermore, the belt is designed in such a way that it comprises a double thread interlining, one thread interlining being wound counter to the second thread interlining such that the threads of one thread interlining cross the threads of the second thread interlining.

15 Claims, 3 Drawing Sheets

WEARING COATING FOR DELIVERY ROLLERS OF A DRAWING ROLLER FRAME

FIELD OF THE INVENTION

The invention relates to a roller drawing apparatus for spinning machines in which the covering for the pressure roller at the output of a drafting field consists of an outer layer and of an inner layer fastened on the core of the pressure roller. The outer layer is thinner and harder than the inner layer, which outer layer loosely surrounds the inner layer so that the outer layer can move relative to the inner layer.

BACKGROUND

A roller drawing apparatus is described in DE 102 60 025.2. Since the apron covering on the withdrawal cylinder has a running speed approximately 40 times greater than is the case in customary drafting aprons, it is very important that the apron covering is well guided and causes as little friction as possible on the deflection rail. The tensioning force required for the guidance of the apron covering is therefore very low and is advantageously only produced in that the apron covering tends to assume an approximately circular form in the circumferential direction in the unloaded state (DE 103 48 452 A1). Conditioned by this low tension with which the apron covering glides over the deflection roller, fibers collect on the deflection roller during a rather long operation of this apparatus. As a consequence, laps form around the deflection rail that hinder the easy gliding over the deflection rail and generate a higher and higher tension that finally leads to breaking of the deflection rail.

Furthermore, the running properties of the apron covering over the deflection rail are adversely affected in that the yarn insert applied to hinder longitudinal expansion is customarily produced by winding a yarn onto the first inner layer, that is then covered with another layer. As a result, it occurs again and again that, at the high running speed, the apron covering behaves asymmetrically corresponding to the winding and has the tendency to run off to one side. This can be counteracted by positioning edges on the deflection rail. However, the borders of the apron covering are stressed and worn down by running against the edge.

SUMMARY

The present invention addresses the problem of avoiding the described disadvantages and of avoiding adverse effects during the gliding of the very rapidly running apron covering over the deflection rail. Additional objects and advantages of the invention will be set forth in part in the following description, or may be obvious from the description, or may be learned through practice of the invention.

It surprisingly turned out that given sufficiently large dimensioning of the circumference of the cross section of the deflection rail, the lap problems of prior art systems can be avoided. The circumference of the cross section of the deflection rail is preferably greater than the length of the longest fiber of the fiber material processed on the drafting apparatus. A running of the rapidly running apron covering against limiting edges is avoided by the curvature of the apron gliding surface of the deflection rail transversely to the running direction of the apron. The limitation by edges can even be entirely eliminated, especially if the covering constructed as an endless apron is provided with a double yarn insert, which yarn inserts are wound in opposing directions. The opposing winding of the yarn inserts eliminates the asymmetric behavior of the apron covering at high running speeds. In addition, the advantage results that when using a rigid holder, the apron covering can still be readily replaced. The rigid holder for the apron covering is preferably mounted on the pressure roller shaft in a freely rotatable manner and is supported via stops on the upper roller carrying arm of the drafting apparatus. In this manner, an especially simple and operationally reliable guidance of the apron covering is achieved.

BRIEF DESCRIPTION OF THE DRAWINGS

Further details of the invention are described using the drawings.

DETAILED DESCRIPTION

Figure 1:
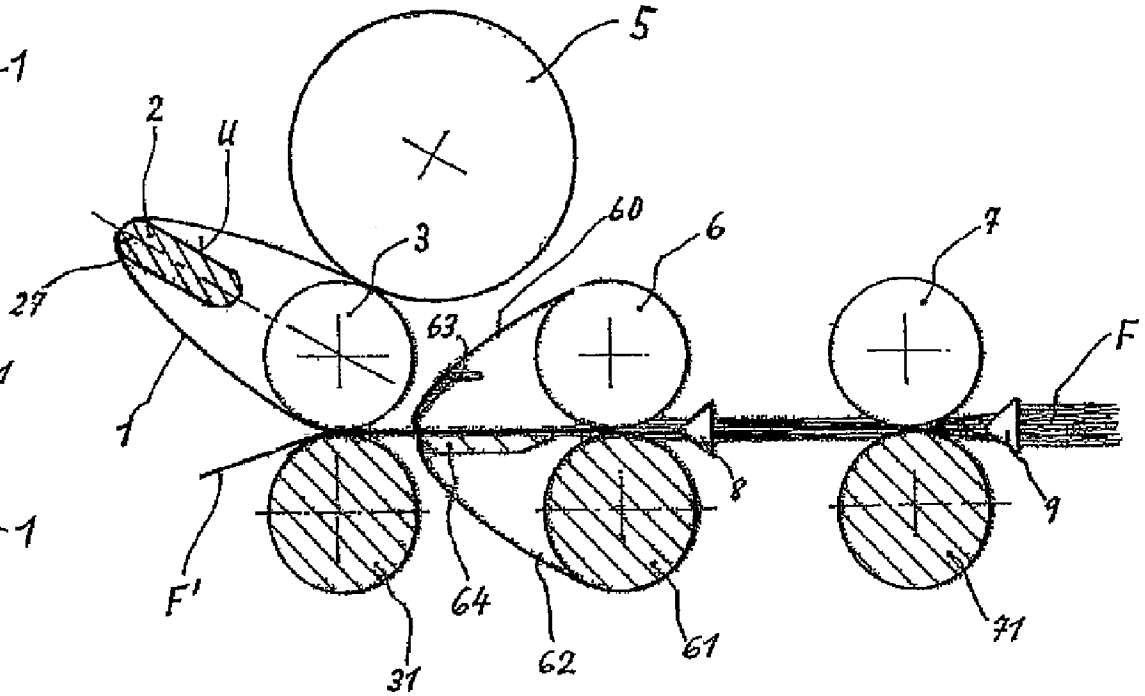
FIG. 1 shows a cross section through the drafting apparatus.

Reference will now be made to embodiments of the invention, one or more examples of which are illustrated in the drawings. Each embodiment is presented by way of explanation of the invention, and not as a limitation of the invention. For example, features illustrated or described as part of one embodiment may be used with another embodiment to yield still a further embodiment. It is intended that the invention include these and other modifications and variations of the embodiments described herein.

The drafting apparatus in FIG. 1 shows the customary construction of a double apron drafting system with lower cylinders 31, 61 and 71 by means of which apparatus fiber structure F is drawn to a yarn F'. The middle pressure roller 6 is looped around by a drafting apron 60 that is guided and tensioned by apron cage 63. Lower cylinder 61 is looped around by a drafting apron 62 that runs over the deflection rail 64 and is pressed against upper apron 60. Compressors 8 and 9 are provided in front of and in the drafting field for the compression of the fiber structure.

The delivery cylinder pair consists of the lower cylinder 31 and the pressure roller 3, that is looped around by an apron covering 1 that runs over deflection rail 2. Since pressure roller 3 has a speed approximately 40 or 60 times greater than pressure rollers 6 and 7, cover apron 1 must run very rapidly. The deflection rail 2 is therefore provided with a smooth, low-fiction apron sliding surface 27 and covering 1, designed as an apron, of pressure roller 3 is tensioned only slightly. The intrinsic tension of apron covering 1 that would result in a circular form of the apron 1 in the free non-tension state, is sufficient for this. Apron covering 1 is stretched by the arrangement of deflection rail 2. The tension produced as a result is already sufficient for the unobjectionable running of apron covering 1.

A clearer (i.e. cleaning) roller 5 is arranged in a customary manner above pressure roller 3 and of apron covering 1 in order to keep apron covering 1 free of fibers. However, during rather long running times of the drafting device, fibers accumulate on the inside of apron covering 1 between apron covering 1 and apron sliding surface 27 of deflection rail 2, which fibers are not eliminated by or cannot be prevented by the clearer roller. These fibers become firmly fixed so that a greater and greater accumulation of fibers develops on gliding surface 27 of deflection rail 2, and the tension of apron covering 1 increases in an inadmissible manner. The tension can even become so great that not only is apron covering 1 considerably braked and the course is thus adversely affected, but also deflection rail 2 breaks.

The accumulation of fibers between apron covering 1 and apron sliding surface 27 of deflection rail 2 is counteracted by the shaping of deflection rail 2, especially of the cross-sectional circumference U. It turned out here that the size of the circumference U is important, and in any case should be greater than the average staple length of the fiber material drawn on the drafting apparatus. Good results were achieved, for example, with a cross-sectional circumference U of deflection rail 2 of at least 1.5 times the average fiber length. Since it is obviously important that the start and the end of a fiber can not close themselves to a ring around circumference U of deflection rail 2, the cross-sectional circumference U of deflection rail 2 should preferably be slightly longer than the longest fiber of the fiber material drawn on the roller drafting apparatus.

Figure 2:
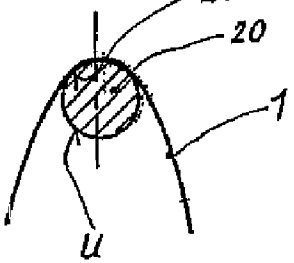
FIGS. 2 to 4 show different cross-sectional profiles of the deflection rail.
Figure 3:
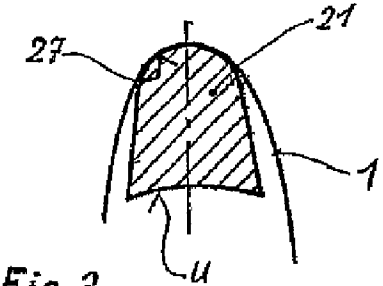
Figure 4:
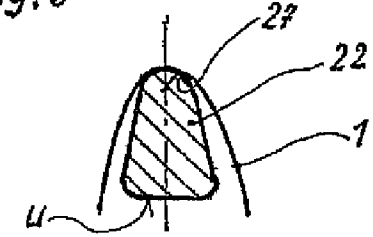

Even the cross-sectional form plays a certain part here. It can be circular in accordance with FIG. 2. However, it turned out that cross-sectional forms like the ones shown in FIG. 1 or in FIGS. 3 and 4 avoid the accumulation of fibers under apron covering 1 the best. However, it is still important that the cross-sectional circumference U is sufficiently large that the fibers cannot form a ring around deflection rail 2. FIG. 3 shows, for example, a cross section in which apron sliding surface 27 has the form of a circular arc whereas the flanks are flattened. In deflection rail 2 according to FIG. 1, the cross section of deflection rail 2 is rectangular; however, the small sides are rounded off in an arched form so that apron sliding surface 27 is rounded off. In the embodiment according to FIG. 4, apron sliding surface 27 of deflection rail 22 is also rounded off; however, the sides are maintained straight. This cross-sectional form is particularly resistant to pressure loads and offers a smaller apron sliding surface 27 so that less friction is exerted on apron covering 1. As can be gathered from FIG. 1, a clearer roller 5 is advantageously arranged above pressure cylinder 3 in order to keep apron covering 1 free of fibers on its outside.

Figure 5:
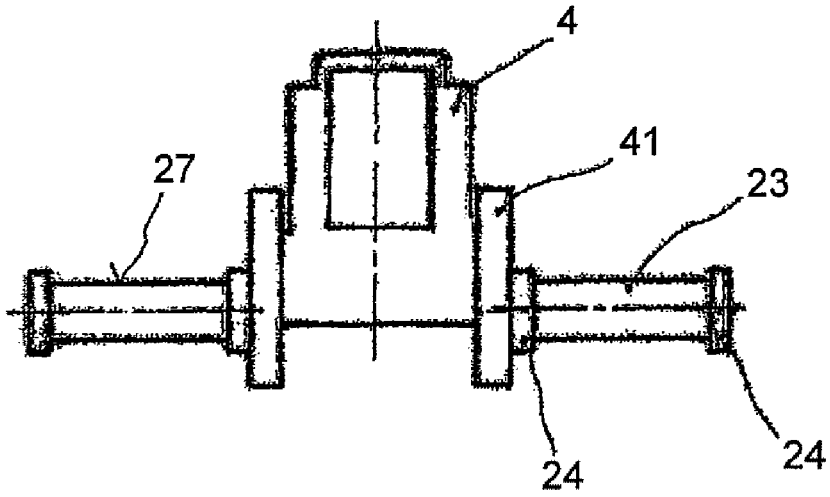
FIG. 5 shows a one-piece design of the deflection rail with the holder.

FIG. 5 shows the holder 4 with two deflection rails 23 arranged as a pair. Holder 4 has cheeks 41 with which it rests on shaft 65 of pressure roller 3. Cheeks 41 are designed in one piece with the two deflection rails 23. Deflection rails 23 comprise cylindrical apron sliding surfaces 27 with lateral edges 24 that prevent a running off of apron covering 1. As a result of the one-piece design of holder 4 with deflection rails 23, this part can be especially advantageously produced and mounted as only one part.

Figure 6:
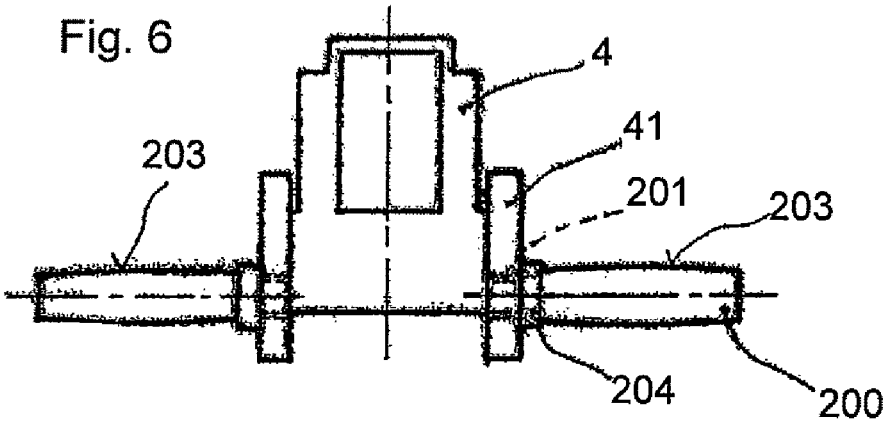
FIG. 6 shows a replaceable deflection rail with holder.

FIG. 6 shows an embodiment similar to that of FIG. 5 but here the deflection rails 200 are screwed into the cheeks 41 of holder by a threading and can be replaced without replacing holder 4. In this manner, an adaptation to different spindle pitches is readily possible. Furthermore, deflection rails 200 are provided with a slightly curved apron sliding surface 203. Apron covering 1 is held in the middle of sliding surface 203 by this curvature transversely to the direction of travel of the apron, which prevents it from running against sleeve 204. An edge can be eliminated on the free side of deflection rail 200, which simplifies the removal of apron covering 1.

Figure 8:
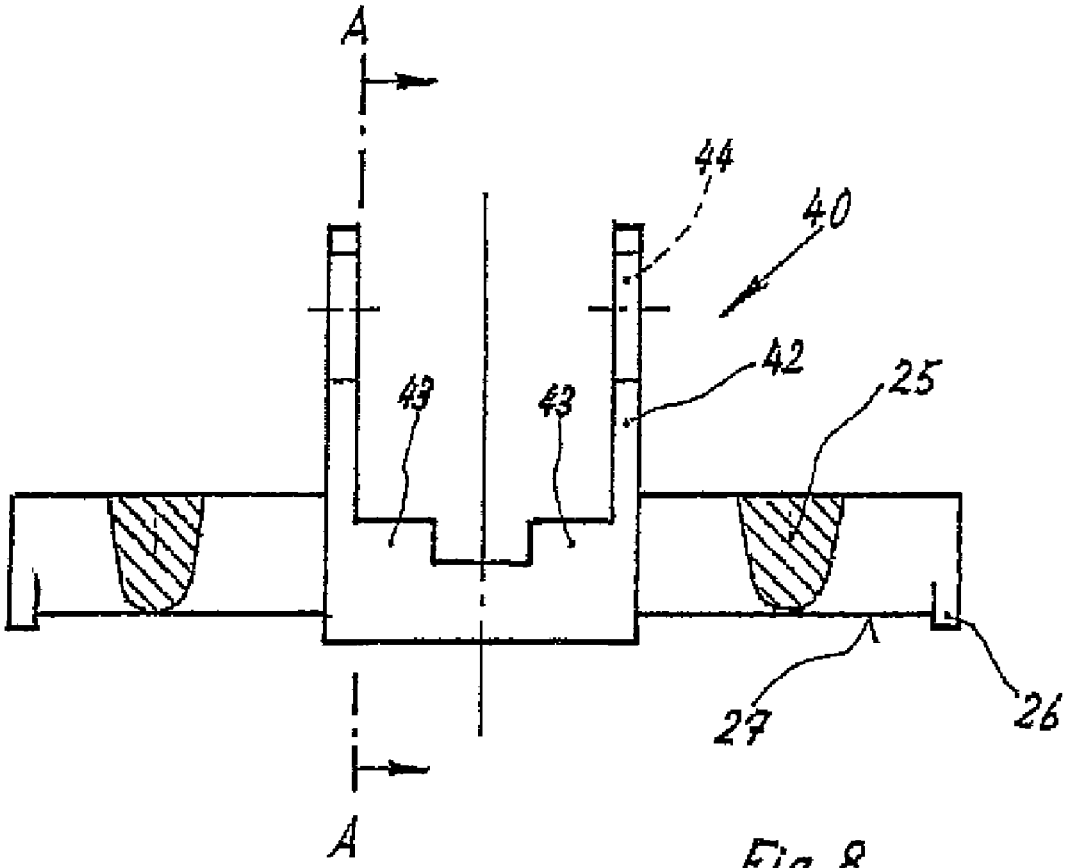
FIG. 8 shows another embodiment of the apron covering holder in a top view.

FIG. 8 shows another embodiment of a holder 40 for apron covering 1. In accordance with the customary design of pressure roller 3, deflection rails 25 are formed in pairs on cheeks 42 of holder 40 so that they form one part with holder 40. Cheeks 42 comprise recesses 44 with which holder 40 rests and is supported on shaft 65 of pressure roller 3. A side edge 26 is formed on each free end of deflection rails 25 which edge extends only over apron sliding surface 203 of deflection rail 25.

Figure 9:
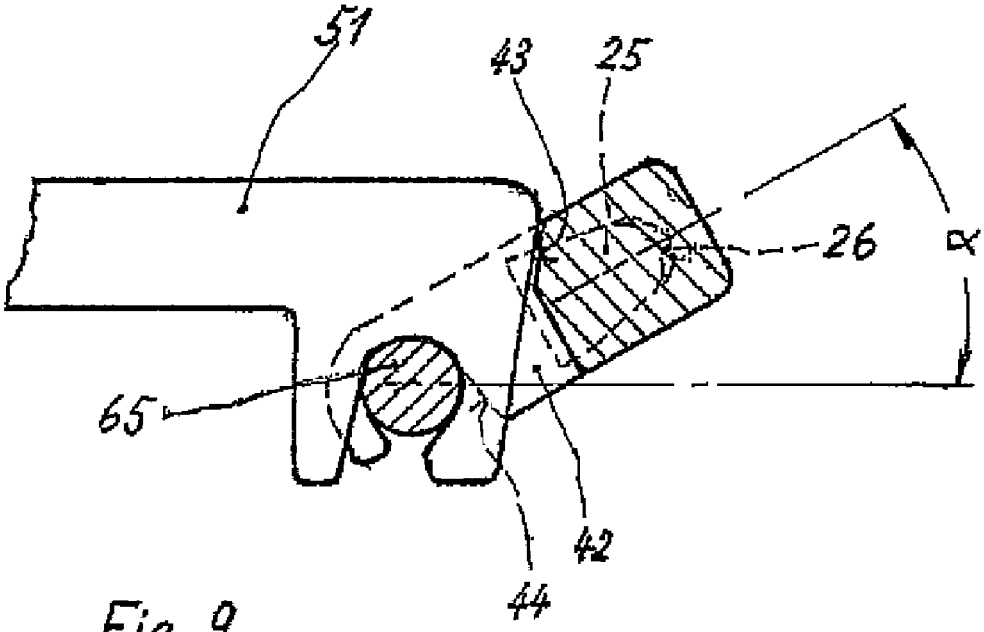
FIG. 9 shows the apron covering holder of FIG. 8 in the insertion state and in section.

FIG. 9 shows holder 40 in insertion position with the view onto holder 40 corresponding to section AA of FIG. 8. The shaft 65 of pressure roller 3 is held in a customary manner in a spring clamp (not shown in more detail) in the upper roller carrying arm 51. Holder 40 grips with cheeks 42 by means of recesses 44 over pressure roller axis 65, around which it can freely pivot. Holder 40 is pivoted counterclockwise during operation in accordance with the torque exerted via pressure roller 3 and apron covering 1 so that it is supported via stops 43 onto upper roller carrier arm 51 and is fixed in this position. This should advantageously take place at an angle $\alpha$ of approximately 30°. This fastening is extremely simple and ensures an assembly and disassembly of the entire holder 40 together with apron 1 without special fastening means. Coating aprons 1 can be easily stripped off pressure roller 3 laterally off deflection rail 25 via the edge 26. Nevertheless, a reliable holding and guidance of apron covering 1 is ensured even at high turning speeds of pressure roller 3.

Figure 7:
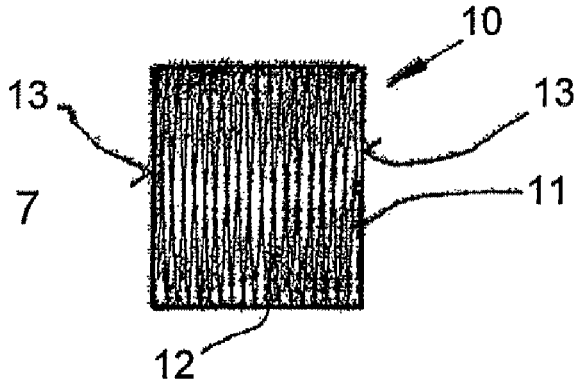
FIG. 7 shows the apron covering with opposingly wound yarn inserts.

As is described in DE 102 60 025.2, apron covering 1 is stiffened by a yarn insert in the direction of travel of apron covering 1 and is therefore largely non-elastic in this direction. The yarn insert is wound in a spiral during the production of apron covering 1 onto the running layer of apron coating 1. During the cutting of apron covering 1 projecting fringes are produced by the yarn insert on the edges. This is disadvantageous because these fringes result in accumulations of fibers. Apron borders 13 (FIG. 7) should be completely smooth so that no fibers are caught on them and entrained. Such a fringe-free cutting is achieved by cutting with a laser.

As a result of the yarn insert applied in spiral form, apron covering 1 exhibits an asymmetric behavior and runs on the one side against edge 24. As a consequence, the smoothly cut borders 13 are roughened and a fringe formation with the above-described negative effects reoccur. The application of a yarn insert 11 in Z form and a yarn insert 12 in S form results in a crossing of the yarns in the spiral winding. Moreover, this counteracts the asymmetric behavior. Apron covering 10 runs uniformly, so that no damage occurs due to running on borders 13. Edges 24 can even be omitted if apron sliding surface 203 of deflection rail 200 has a slight curvature transversely to the direction of travel of the apron. Apron covering 10 is constantly held and guided as a result in the middle of sliding surface 203. The omission of outer edges 24 also has the advantage that apron covering 10 can be more readily replaced, even if deflection rail 200 is rigidly arranged. In the embodiment according to FIG. 6 apron covering 10 can simply be pushed off the deflection rail 200 laterally. A raising over an edge is not required.

All these described measures bring about an easy and trouble-free course of apron covering 1 or 10. Since this apron covering 1 or 10 runs at a very high speed, slight disturbances work themselves out to a large extent. The described measures can avoid disturbances in a simple manner and achieve an unobjectionable course of covering 1 even at high turning speeds of pressure roller 3.

It should be appreciated by those skilled in the art that modifications and variations can be made to the embodiments described herein without departing from the scope of the appended claims.

The invention claimed is:

1. A method of drawing a fiber structure to a yarn for a spinning machine having a roller drafting apparatus that defines a drafting field for fibers having a known average staple length, the roller drafting apparatus having a middle pressure roller that is looped around by a drafting apron that is guided and tensioned by an apron cage, the roller drafting apparatus having a pressure roller and opposed lower cylinder at the output of the drafting field, the pressure roller having an inner layer fastened around a core of the pressure roller, wherein an endless cover apron travels in a running path over the pressure roller and a deflection rail, the cover apron formed as an outer layer that loosely surrounds the inner layer of the pressure roller, the method comprising:

selecting a deflection rail with a cross-sectional circumference that is greater than the known average staple length of the fibers drawn on the roller drafting apparatus;

tensioning the endless apron covering only slightly such that the intrinsic tension of the cover apron would result in a circular form of the cover apron in the free non-tensioned state;

rapidly running the pressure roller at high running speeds many times greater than the speed of the middle pressure roller; and producing yarn at the output of the drafting field.

2. The method as in claim 1, wherein the cross-sectional circumference of the deflection rail is at least 1.5 times the average staple length of the fibers.

3. The method as in claim 1, wherein the cross-sectional circumference of the deflection rail is greater than the longest fibers of fiber material drawn on the roller drafting apparatus.

4. The method as in claim 1, wherein the deflection rail comprises an apron sliding surface wherein the cover apron is deflected around the deflection rail having a circular arc cross-section.

5. The method as in claim 4, wherein the deflection rail comprises flattened sides that extend rearward of the circular sliding surface.

6. The method as in claim 5, wherein the deflection rail comprises a rectangular cross-section rearward of the circular sliding surface, the rectangular cross-section having smaller sides that are rounded off.

7. The method as in claim 1, wherein the deflection rail has a transverse profile with an outward curvature that is transverse to a direction of travel of the cover apron.

8. The method as in claim 1, wherein the deflection surface comprises a transverse free end without a retaining edge such that the cover apron can be slid off of the transverse free end.

9. The method as in claim 1, wherein the deflection rail is rigidly supported relative to the pressure roller by a holder fastened to a shaft of the pressure roller.

10. The method as in claim 9, wherein the holder is rotatable on the pressure roller shaft.

11. The method as in claim 10, wherein the holder comprises cheeks with recesses that fit over the pressure roller shaft.

12. The method as in claim 10, further comprising providing stops that engage against and define a rotated operational position of the holder.

13. The method as in claim 1, the cover apron is tensioned when running over the deflection rail in operation of the drafting apparatus by the bending stiffness of the cover apron.

14. An endless apron for use in a roller drafting apparatus for a spinning machine that defines a drafting field for fibers having a known average staple length, the drafting apparatus having a pressure roller and opposed lower cylinder at the output of the drafting field, the pressure roller having an inner layer fastened around a core of the pressure roller, wherein the endless apron travels in a running path over the pressure roller and a deflection rail, the apron formed as an outer layer that loosely surrounds the inner layer, the apron further comprising:

a first yarn insert having yarns wound in a first direction;

a second yarn insert having yarns wound in a second opposing direction against the yarns of the first yarn insert; and wherein the opposed yarn inserts provide the apron with a low expansion in the running direction of the apron and prevent asymmetrical running of the apron over the deflection rail.

15. The endless apron as in claim 14, wherein the first yarn insert is formed by a layer of yarns wound over a tubular body in a first direction, and the second yarn insert is formed by a second layer of yarns wound over the first layer of yarns in an opposite direction, with an additional layer of material formed over the second layer of yarns.

* * * * *